US005368489A

United States Patent [19]

Confalone, Jr. et al.

[11] Patent Number: 5,368,489

[45] Date of Patent: Nov. 29, 1994

[54] LUMINESCENT DISPLAY DEVICE

[75] Inventors: Peter A. Confalone, Jr., Franklin; Ronald W. Dart, Wayland, both of Mass.

[73] Assignee: Procorp. Inc., Framingham, Mass.

[21] Appl. No.: 85,194

[22] Filed: Jun. 29, 1993

Related U.S. Application Data

[63] Continuation of Ser. No. 703,905, May 22, 1991, Pat. No. 5,249,969.

[51] Int. Cl.[5] ..... B43L 1/12

[52] U.S. Cl. ..... 434/410; 434/425

[58] Field of Search ..... 434/410, 408, 425; 40/219, 542, 362

[56] References Cited

U.S. PATENT DOCUMENTS 2,697,884 12/1954 Dechert .
2,818,662 1/1958 Payne et al. .
3,761,343 9/1973 Kinberg .
4,011,665 3/1977 Port .
4,051,609 10/1977 Boursaw ..... 434/410
4,927,748 5/1990 Kinberg .
4,988,301 1/1991 Kinberg ..... 434/410
5,098,502 3/1992 Smolinski .

*Primary Examiner*—Stephen R. Crow
*Assistant Examiner*—Karen A. Jalbert
*Attorney, Agent, or Firm*—Wolf, Greenfield & Sacks

[57] ABSTRACT

A luminescent writing or display device and method of manufacturing the same which includes a transparent vinyl sheet containing a fluorescent or neon dye and an opaque sheet made from coated paperboard stock. An acrylic resin varnish is provided on a portion of the paperboard stock for forming a contact surface with the vinyl on which an image may be created by applying pressure thereto. The image is readily erased by separating the sheets. Another portion of the paperboard stock receives printing inks for providing a permanent ink display on a header portion of the device. The device may be manufactured in a continuous process at a reduced cost.

6 Claims, 3 Drawing Sheets

LUMINESCENT DISPLAY DEVICE

This application is a continuation of application Ser. No. 07/703,905, filed May 22, 1991, now U.S. Pat. No. 5,249,969.

FIELD OF THE INVENTION

This invention concerns an improved writing and display device for producing a luminescent image by the application of pressure, and an improved method of making a display device.

PROBLEM AND THE PRIOR ART

Writing and display devices of the type disclosed in prior U.S. Pat. Nos. 3,761,343, 4,011,665, and 4,927,748, are now well known and have been used in various toy items and other writing or display products. The subject of the foregoing patents includes a transparent plastic sheet that contains a luminescent dye and a complimentary opaque sheet disposed contiguous thereto so that when pressure is applied, the two sheets tend to adhere to one another along the points of applied pressure to produce a luminescent image. However, these prior art devices have certain disadvantages including in particular the costs of their materials and manufacture and problems with the dye bleeding out of the transparent vinyl sheet onto the adjacent vinyl opaque sheet. The prior art has sought to avoid the bleeding problem by either providing a protective sheet or insert between the transparent and opaque sheets, which adds to the cost of manufacture and is inconvenient to use, or adding additional plasticizers to the vinyl transparent sheet to prevent migration. Still further, these prior known devices use a vinyl opaque sheet which must be separately adhered to a more rigid backing sheet, and this adds to the costs of material and manufacture.

OBJECTS

An object of this invention is to provide a writing or display device for producing a luminescent image which avoids the use of a vinyl opaque sheet.

Another object is to provide a luminescent display device which uses less expensive materials and is less expensive to manufacture.

A further object is to provide a luminescent display device which can be manufactured in a continuous process.

Yet another object is to provide a luminescent display device in which color printing can be provided on a portion of the opaque sheet in a manner which is relatively inexpensive to manufacture.

SUMMARY OF THE INVENTION

The foregoing objects and other features and advantages are attained by a luminescent display device which includes an opaque sheet made of sealed paperboard stock having an acrylic resin varnish coating applied thereto to form a first contact surface, and a transparent sheet made of a pliable vinyl type compound containing a luminescent dye and which forms a second contact surface. The first and second contact surfaces are disposed adjacent to one another such that the application of pressure causes intimate contact between the surfaces to produce a luminescent image. The transparent sheet is attached along one edge to the opaque sheet and the contact surfaces are readily separable to erase the image by pulling apart the two sheets along the non-joined edges.

A particular advantage of the writing and display device of this invention is that it can be manufactured in a continuous process at a relatively low cost. In this method, a continuous strip of sealed paperboard is sent past various stations to apply: 1) printing ink on a header portion of the card; 2) varnish to form the first contact surface; and 3) adhesive for joining a continuous vinyl strip and the paperboard strip at a subsequent combining station where the paperboard and vinyl strips are brought together, aligned and joined. The combined strips are then sent to a cutting station which separates the strip into individual display devices and may further provide a decorative shaped edge to each device.

DETAILED DESCRIPTION OF THE PREFERRED EMBODIMENTS

Figure 4:
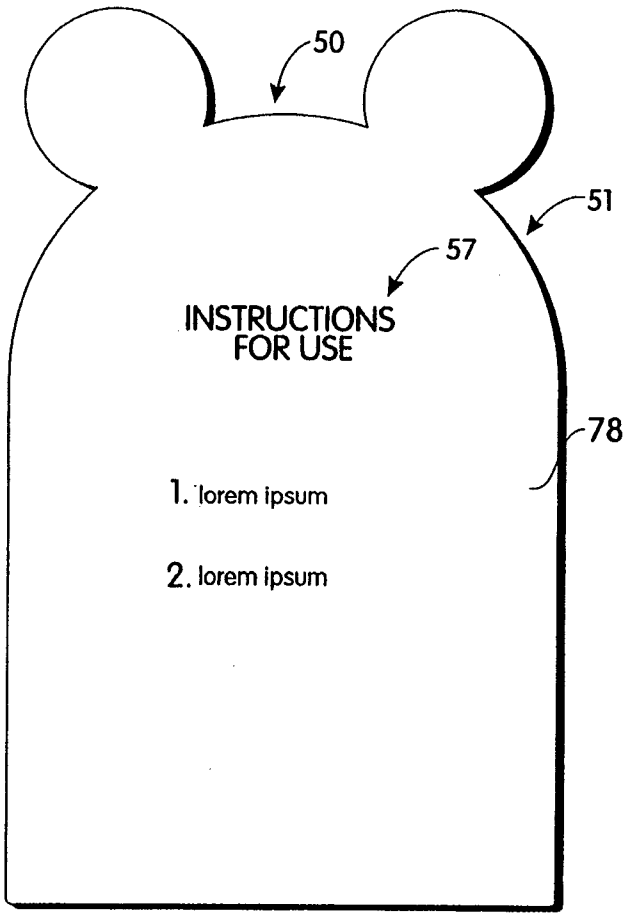
FIG. 4 is a rear view of the display device of FIG. 2.
Figure 3:
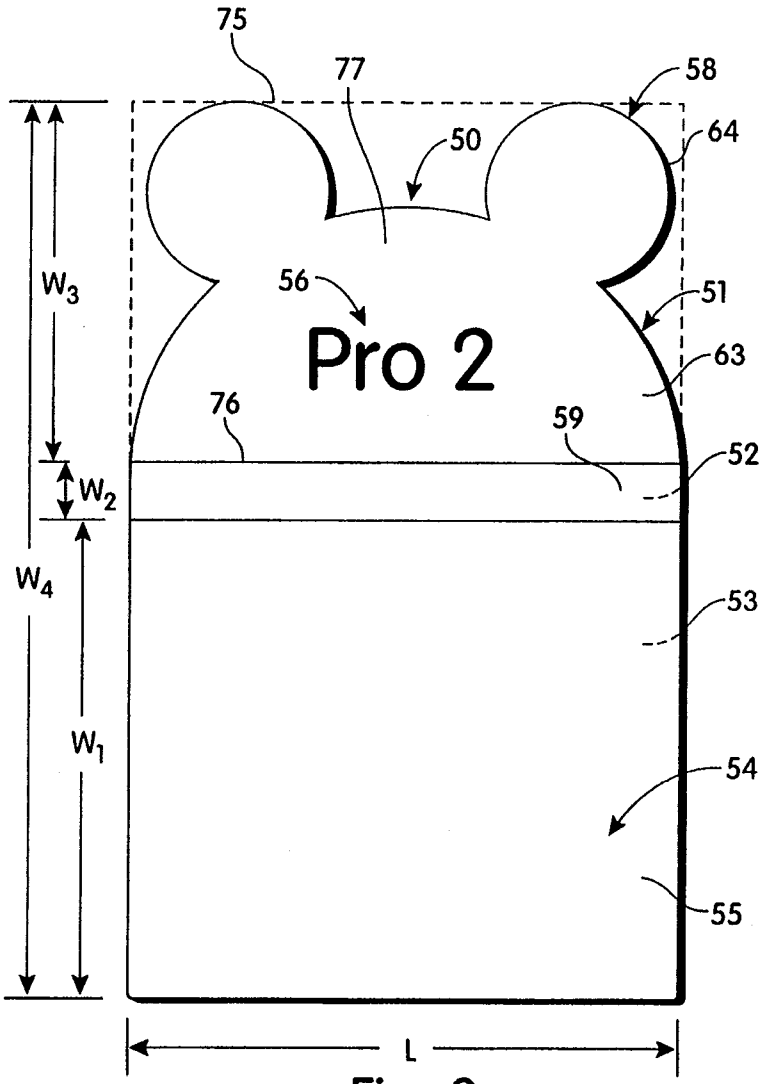
FIG. 3 is a front view of the display device of FIG. 2.
Figure 2:
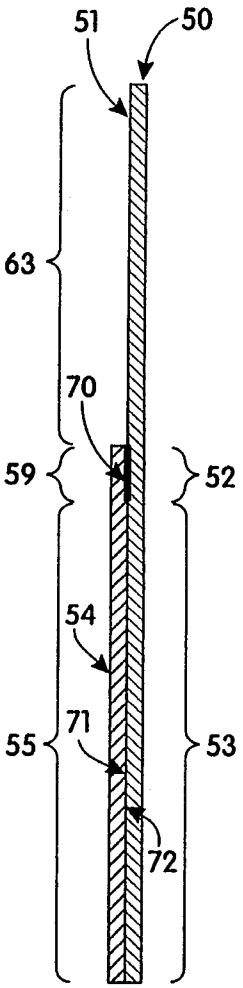
FIG. 2 is a side view of the display device of this invention.

There is shown in FIGS. 2–4, side, front and rear views of one embodiment of the display device 50 of this invention. The device includes a paperboard opaque sheet 51, and a transparent vinyl sheet 54 containing a luminescent material such as a fluorescent dye or pigment. The paperboard sheet 51 is of length L and width $W_4$ and its entire front surface 77 is sealed with a coating or sealant, such as a clay coating, which promotes the adherence or "hold out" of varnish, as well as printing inks. The clay sealant on this coated paperboard is desirable to ensure that a smooth and even layer of varnish can be applied in a thin coating; without the sealant, the varnish may be absorbed in the paperboard and produce an uneven (i.e., hills and valleys) surface to the varnish coating which will not adhere properly to the vinyl sheet. The clay sealant is also preferred underneath the paperboard portion to be printed with inks because it produces a better ink display.

The vinyl sheet 54 is disposed over a lower portion of paperboard sheet 51 defined by length L and combined width $W_1+W_2$. Lower portion 55 of vinyl sheet 54, of dimensions $L_1 \times W_1$, is disposed over a varnish-coated portion 53 of paperboard sheet 51 having the same dimensions and which together form the usable image forming surface of the device. An upper edge portion 59 of the vinyl sheet 54 is attached to a middle portion 52 of paperboard sheet 51 by means of an adhesive 70 disposed between the two sheets and having dimensions $L \times W_2$. A top header portion 63 of the paperboard sheet 51, of dimensions $L \times W_3$, extends beyond the upper edge 76 of the vinyl sheet 54. Header portion 63 has a shaped decorative edge 64 and a permanent display 56 formed by printing inks applied directly to the front surface of the paperboard. The rear surface 78 of paperboard sheet 51 (shown in FIG. 4) may likewise be sealed and have a permanent ink display 57 of writing or pictorial information, such as the "instructions for use" shown in FIG. 4. As a further alternative, printing ink may also be applied to the paperboard sheet underneath the varnish coating. As described hereinafter, the paperboard sheet 51 originally has a rectangular shape defined by dimensions $L \times W_4$ before forming the decorative edge 64, as shown by phantom lines 75 in FIG. 3.

Figure 6:
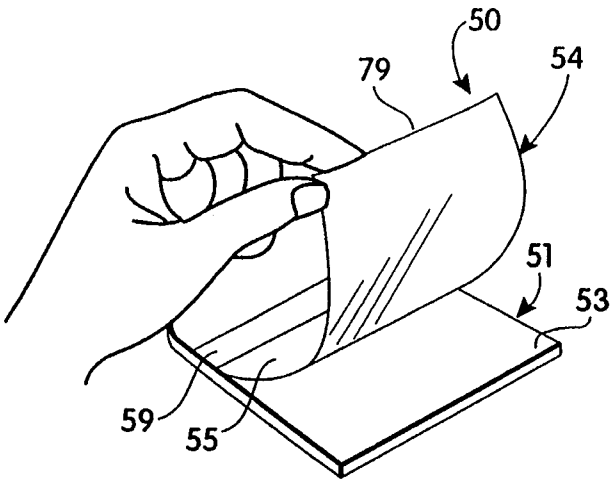
FIG. 6 is a front perspective view showing the same user erasing the image by separating the sheets of the display device.
Figure 5:
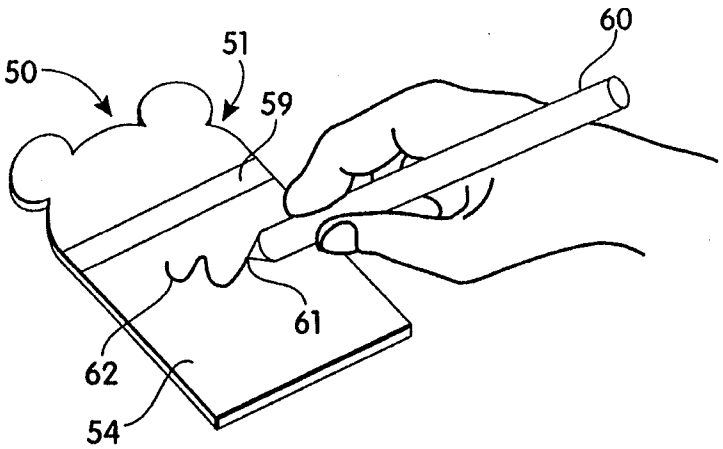
FIG. 5 is a front perspective view showing a user creating an image on the display device with a blunt instrument.

As shown in FIG. 5, the user's hand holds a blunt pen-shaped instrument 60 having a rounded point 61 for applying pressure to the upper surface of vinyl sheet 54 to create an image 62. The application of pressure causes intimate contact between the two smooth adjoining surfaces 71, 72 (see FIG. 2) of the vinyl sheet and paperboard sheets respectively. As shown in FIG. 6, to erase the image the user simply pulls up on vinyl sheet 54 from the bottom edge 79 to separate the image portions 55 and 53 of the vinyl sheet and paperboard sheet respectively.

Figure 1:
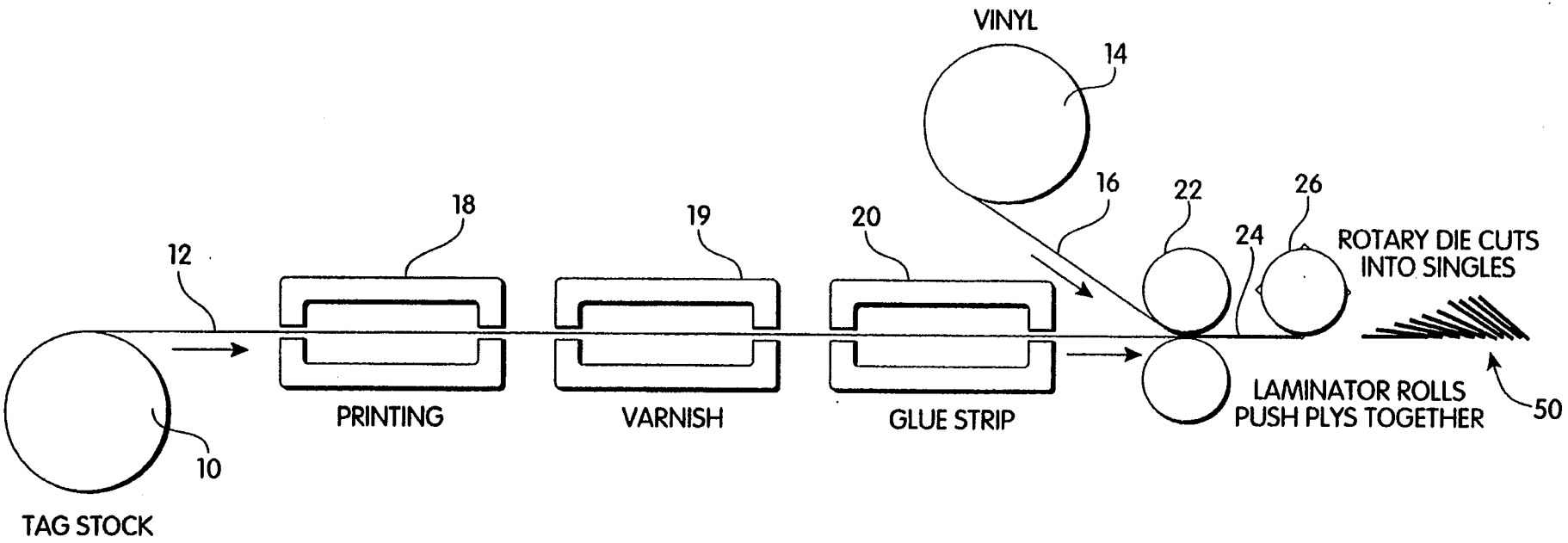
FIG. 1 shows the manufacturing process for making the display device of this invention.

A continuous method of manufacturing the display device is shown in FIG. 1. A continuous strip of tag stock paperboard 12 is provided on reel 10 and fed through a series of three stations 18, 19, 20 before being joined at combining station 22 with a separate continuous strip of vinyl 16 being fed from reel 14. The paperboard strip 12 is of width $W_4$ (see FIG. 3) and is fed first to printing station 18 where one or more inks may be applied to the top header portion 63 of strip 12 defined by width $W_3$ to form a permanent ink display 56. Inks may also be applied to the rear surface 78 of the paperboard strip to form additional printed text or graphics, such as the instructions for use 57 shown in FIG. 4, at the same station. It is preferred for cost reasons to use a flexographic ink printing process in which a rubber plate receives ink from a roll and transmits it directly to the paperboard. Waterbased inks, which are fast drying, may be used to achieve four color process blocks. Other types of printing processes which may be used include rotary letter press, offset lithography, and the gravure process.

At the second station 19, varnish is applied to the bottom portion of strip 12 defined by width $W_1$ to form coated portion 53. The varnish is applied as a liquid and subsequently cured or hardened by the application of ultraviolet light. Preferably, a 100% solids varnish is used which may be UV-cured, but any varnish type coating may be used which forms a smooth glossy surface and that interacts properly with the vinyl via a static cling type of temporary adherence or attracting force.

At the third station 20, a glue or adhesive strip is applied to a middle portion 59 of paperboard strip 12 defined by width $W_2$. A waterbased emulsion glue may be applied in continuous fashion to the strip by means of nozzle extrusion. Alternatively, a solvent based adhesive or some type of heat seal bond could be used.

Immediately after applying the glue strip, the paperboard strip 12 is sent to a pair of laminator rolls together with a continuous strip of vinyl 16 whereby the upper edge of the vinyl strip is attached to the adhesive portion 59 of the paperboard strip 12 and the remaining portion 55 of the vinyl is aligned over the coated portion 53 of the paperboard strip 12. The laminator rolls push the two strips together to form a combined strip 24 which is then sent to a final cutting station 26 for separating the combined strip 24 into individual display devices 50 of dimensions $L \times W_4$. One or more rotary dies may be used for cutting the strip 24 into consecutive lengths L (see FIG. 3) and in addition may form a shaped decorative edge along any part of the device 50, such as edge 64 shown in FIG. 3.

The display device of this invention can be produced at a considerably reduced cost compared to the prior known devices because of the relatively low cost materials used and the ability to manufacture the device in a continuous automated process. Still further, the ability to print by a flexographic process on a header portion of the paperboard stock and the ability to die-cut decorative shapes are significant benefits of this invention.

The following example describes certain materials which are particularly suited for use in this invention.

EXAMPLE

A 10 point (i.e., 10/1000 inch thick) paperboard tag stock is used having a clay type coating or sealer on one or both sides which promotes adherence or hold out of the varnish and inks. Providing the sealant on both sides of the stock is more costly, but enables printing of inks on both sides of the paperboard. Paperboard of other thicknesses may be used, such as 8 to 20 point, depending on the stiffness desired and cost factors.

The varnish used is an acrylic resin type liquid varnish which may be cured by the application of ultraviolet light. A specific example is sold by Rad-Cure Corporation, Livingston, N.J., under the trade name "RAD-KOTE" and contains the following chemical ingredients:

| Ingredient | % by weight |
|---|---|
| Epoxy-Acrylic resin | 38 |
| Multifunctional Acrylates | 46 |
| Phenyl-Ketone | 10 |
| Organofunctionalamine | 5 |
| Dimethylpolysiloxane | 1 |
| Total Ingredients | 100 |

The varnish coating is from about 0.1 to about 0.3 mils (0.0001 to 0.0003 inches) in thickness.

The vinyl sheet is an iridescent vinyl (lime) sold by American Renolit Corporation, Whippany, N.J., having a thickness of 10 mils (10/1000 inch). This is a hand-soft, flexible fluorescent vinyl which is edge lit by pressing on the face of the vinyl with a narrow point, such as a stylus having a rounded edge of 3/16" in diameter. The vinyl sheet may be about 8 to 16 mils in thickness, the thinner films providing better light transmission. It is available in other colors, i.e., pink, orange, red and yellow.

A water based emulsion glue is used as the adhesive and is nozzle extruded onto the paperboard strip. Other solvent based adhesives or heat bonding may also be used.

A flexographic printing process is used with water based inks, such as "Solvent Safe" water based flexographic printing inks sold by Louis O. Werneke Company, Plymouth, Minn. These inks are FDA approved for indirect food contact and thus are safe for use on toys.

The strip of paperboard stock is 5" wide and is joined with a 3" wide vinyl strip. A $\frac{5}{8}$" wide strip of glue is provided for attaching the vinyl and paperboard stock. The combined strips are cut into individual 3"×5" rectangular-shaped display devices in which the vinyl occupies the lower 3"×3" square portion (including the $\frac{5}{8}$" glue strip). The header occupies the top 2"×3" portion. The device may be of various dimensions, based on best use of the printing press capacity and cost of material limitations.

While the invention has been described with respect to a particular embodiment thereof, it will be understood that variations and modifications may be made without departing from the spirit or scope of the invention.

What is claimed is:

1. An improved display device for producing a semi-permanent luminescent image consisting essentially of:

a paperboard sheet having a sealed surface for improved ink and varnish adherence on at least a portion of the sheet;

one or more inks applied to at least a portion of the sealed surface;

a varnish coating on at least a portion of the sealed surface of the paperboard sheet, which forms a first contact surface; and a pliable vinyl type plastic sheet containing a luminescent dye, which forms a second contact surface and is disposed adjacent to the first contact surface;

wherein upon the application of pressure the first and second contact surfaces are urged into intimate contact at the points of applied pressure to form a luminescent image along said points and wherein said sheets are readily separable for effecting the erasure of any luminescent image formed thereon.

2. The device of claim 1, wherein a clay-type coating forms the sealed surface on the paperboard sheet.

3. The device of claim 2 wherein the varnish is an acrylic resin type varnish.

4. The device of claim 1, wherein the paperboard sheet is about 8 to about 20 mils in thickness, the varnish coating is about 0.1 to about 0.3 mils in thickness, and the vinyl type plastic sheet is about 8 to about 16 mils in thickness.

5. The device of claim 1, wherein the inks are printed on a header portion of the device.

6. The device of claim 1, wherein the inks are applied below the varnish coating of the first contact surface.

* * * * *